US008523205B2

(12) United States Patent
Hsu et al.

(10) Patent No.: US 8,523,205 B2
(45) Date of Patent: Sep. 3, 2013

(54) SWING SKATEBOARD

(76) Inventors: Yung-Ta Hsu, Taichung (TW); Kuo-Chen Wang, Taichung (TW)

( * ) Notice: Subject to any disclaimer, the term of this patent is extended or adjusted under 35 U.S.C. 154(b) by 209 days.

(21) Appl. No.: 13/173,095

(22) Filed: Jun. 30, 2011

(65) Prior Publication Data

US 2013/0001910 A1 Jan. 3, 2013

(51) Int. Cl.
*A63C 17/01* (2006.01)

(52) U.S. Cl.
USPC ..... 280/87.042; 280/87.041

(58) Field of Classification Search
USPC ..... 280/87.042, 87.41, 87.03
See application file for complete search history.

(56) References Cited

U.S. PATENT DOCUMENTS

| | | | | | |
|---|---|---|---|---|---|
| D150,401 | S * | 8/1948 | Brickson | D21/765 |
| 4,234,204 | A * | 11/1980 | Tibbals | 280/87.042 |
| 4,337,963 | A * | 7/1982 | Stevenson | 280/87.042 |
| 5,347,681 | A * | 9/1994 | Wattron et al. | 16/30 |
| 5,826,895 | A * | 10/1998 | Bradfield | 280/87.042 |
| 5,984,328 | A * | 11/1999 | Tipton | 280/87.042 |
| 6,193,249 | B1 * | 2/2001 | Buscaglia | 280/87.042 |
| 6,419,249 | B1 * | 7/2002 | Chen | 280/87.042 |
| 6,428,022 | B1 * | 8/2002 | Namiki | 280/87.042 |
| 7,150,461 | B2 * | 12/2006 | Schnuckle et al. | 280/87.05 |
| 7,195,259 | B2 * | 3/2007 | Gang | 280/87.042 |
| 7,338,056 | B2 * | 3/2008 | Chen et al. | 280/87.042 |
| 7,367,572 | B2 * | 5/2008 | Jiang | 280/87.042 |
| 7,484,742 | B2 * | 2/2009 | Choi | 280/87.042 |
| 7,600,768 | B2 * | 10/2009 | Chen et al. | 280/87.042 |
| 7,766,351 | B2 * | 8/2010 | Chen et al. | 280/87.042 |
| 7,891,680 | B2 * | 2/2011 | Chen et al. | 280/87.042 |
| 8,075,006 | B2 * | 12/2011 | Smith | 280/87.042 |
| 8,118,319 | B2 * | 2/2012 | Hsieh | 280/87.042 |
| 8,297,630 | B2 * | 10/2012 | O'Rourke | 280/87.042 |
| 2010/0127468 | A1 * | 5/2010 | Park | 280/87.042 |
| 2011/0006497 | A1 * | 1/2011 | Chen et al. | 280/87.042 |
| 2011/0133420 | A1 * | 6/2011 | Smith | 280/87.042 |
| 2012/0086181 | A1 * | 4/2012 | Kinnaman | 280/87.042 |
| 2012/0161409 | A1 * | 6/2012 | Young | 280/87.042 |
| 2012/0187648 | A1 * | 7/2012 | Chen | 280/87.042 |
| 2013/0001910 | A1 * | 1/2013 | Hsu et al. | 280/87.042 |

* cited by examiner

*Primary Examiner* — Jeffrey J Restifo
(74) *Attorney, Agent, or Firm* — Guice Patents PLLC

(57) ABSTRACT

A swing skateboard includes a board body, a front roller unit and a rear roller unit. The front roller unit has a front roller fork rotatably disposed under a bottom face of the board body, and a front roller rotatably mounted on the front roller fork. The rear roller unit has a rear roller shaft mounted under the bottom face of the board body, and two rear rollers respectively rotatably disposed at two ends of the rear roller shaft. A user can wiggle his/her body to tilt the board body of the skateboard and laterally swing the front roller unit so as to control and move the skateboard forward.

8 Claims, 8 Drawing Sheets

SWING SKATEBOARD

BACKGROUND OF THE INVENTION

1. Field of the Invention

The present invention relates generally to a skateboard, and more particularly to a swing-type skateboard.

2. Description of the Related Art

Currently, the most popular skateboard is the skateboard with four rollers. The four rollers are respectively positioned at a front end and a rear end of the skateboard to provide very good stability in skating. However, in use of such skateboard, a user must tread the ground with one foot to help in skating and moving the skateboard forward. Moreover, the operational sensitivity of such skateboard is poor. In addition, the board body of such skateboard is made of wooden board. It is hard to process the wooden board and the cost is high. As a result, the board body of the skateboard generally has a quite monotonous configuration without changeability. Furthermore, the adoption of wooden board as the material of the board body leads to environmental protection problem due to tree logging.

Another type of skateboards is provided. Such skateboard has only two rollers respectively positioned at the front end and the rear end thereof. However, the front and rear rollers of such skateboard are arranged in alignment and such skateboard contacts the ground only at two points. Therefore, such skateboard has low stability and is hard to use. Only a very experienced player can play such skateboard well.

SUMMARY OF THE INVENTION

It is therefore a primary object of the present invention to provide a swing skateboard, which has very good operational sensitivity and stability. A user can wiggle his/her body to tilt the skateboard and drive the skateboard forward.

It is a further object of the present invention to provide a swing skateboard, which has enhanced structural strength and is able to bear greater load.

To achieve the above and other objects, the swing skateboard of the present invention includes a board body, a front roller unit and a rear roller unit. The board body is an elongated body. The front roller unit has a front roller fork rotatably disposed at a front end of the bottom face of the board body, and a front roller rotatably mounted on the front roller fork. Accordingly, the front roller unit can 360-degree swivel. The rear roller unit has a rear roller shaft mounted under the bottom face of the board body, and two rear rollers respectively rotatably disposed at two ends of the rear roller shaft.

Accordingly, the skateboard contacts the ground at three points to have better stability for a user to conveniently operate the skateboard. Especially, a user can wiggle his/her body to tilt the board body leftward and rightward and make the front roller unit responsively laterally swing so as to urge the skateboard to naturally move forward.

The bottom face of the board body is formed with raised/recessed reinforcement structures to enhance load capacity of the skateboard. The board body can be made of plastic material.

The present invention can be best understood through the following description and accompanying drawings, wherein:

DETAILED DESCRIPTION OF THE PREFERRED EMBODIMENTS

Figure 1:
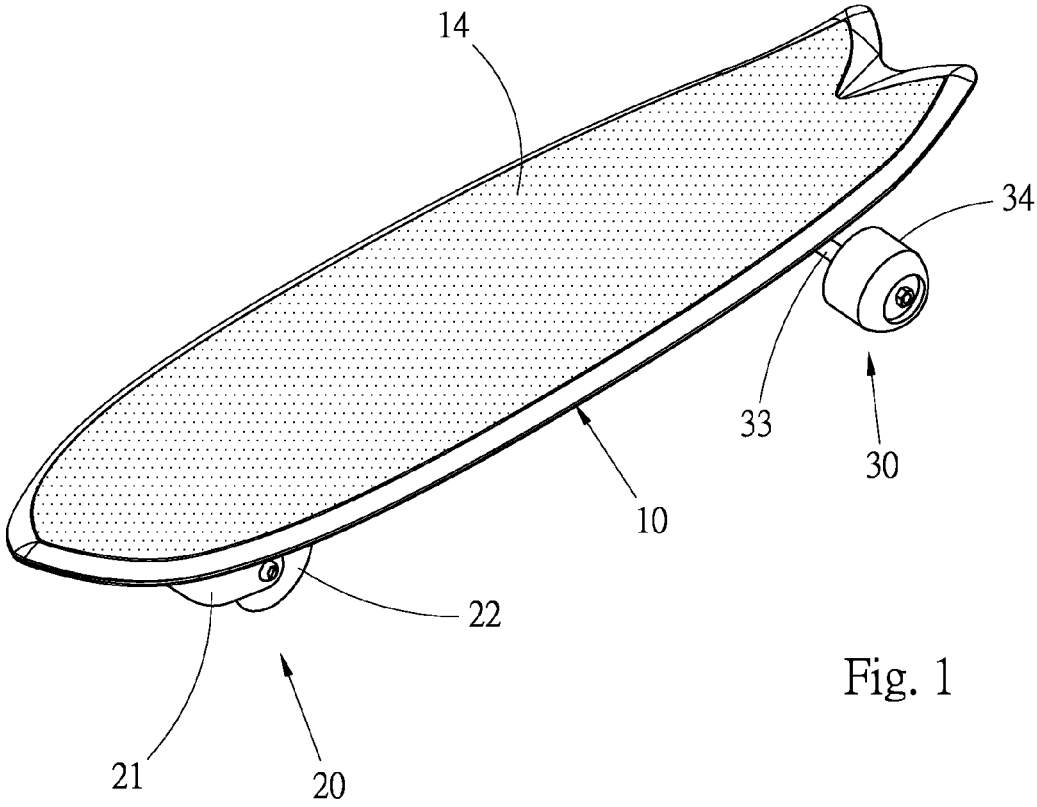
FIG. 1 is a perspective assembled view of a preferred embodiment of the present invention.
Figure 2:
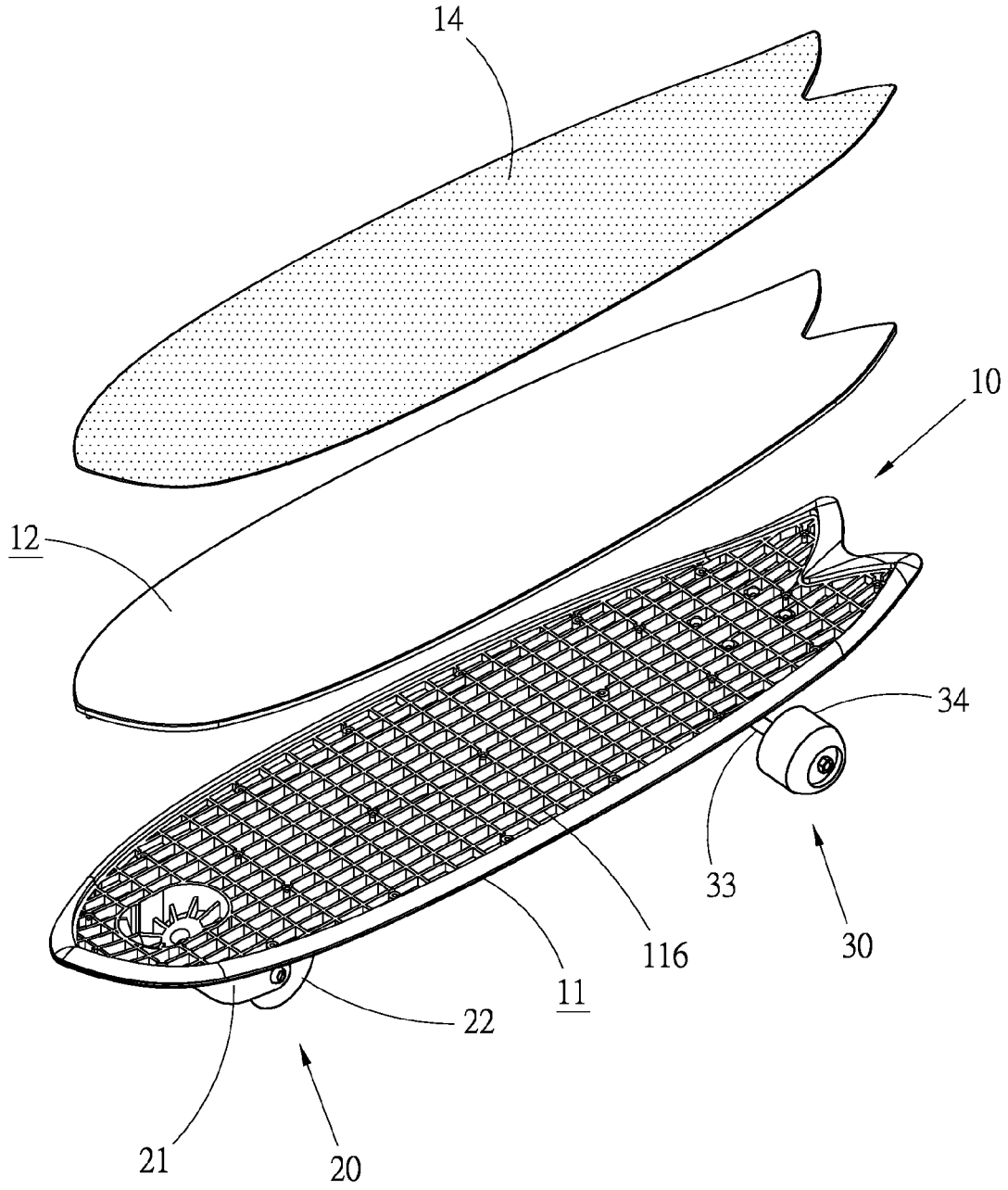
FIG. 2 is a perspective exploded view of the preferred embodiment of the present invention.
Figure 3:
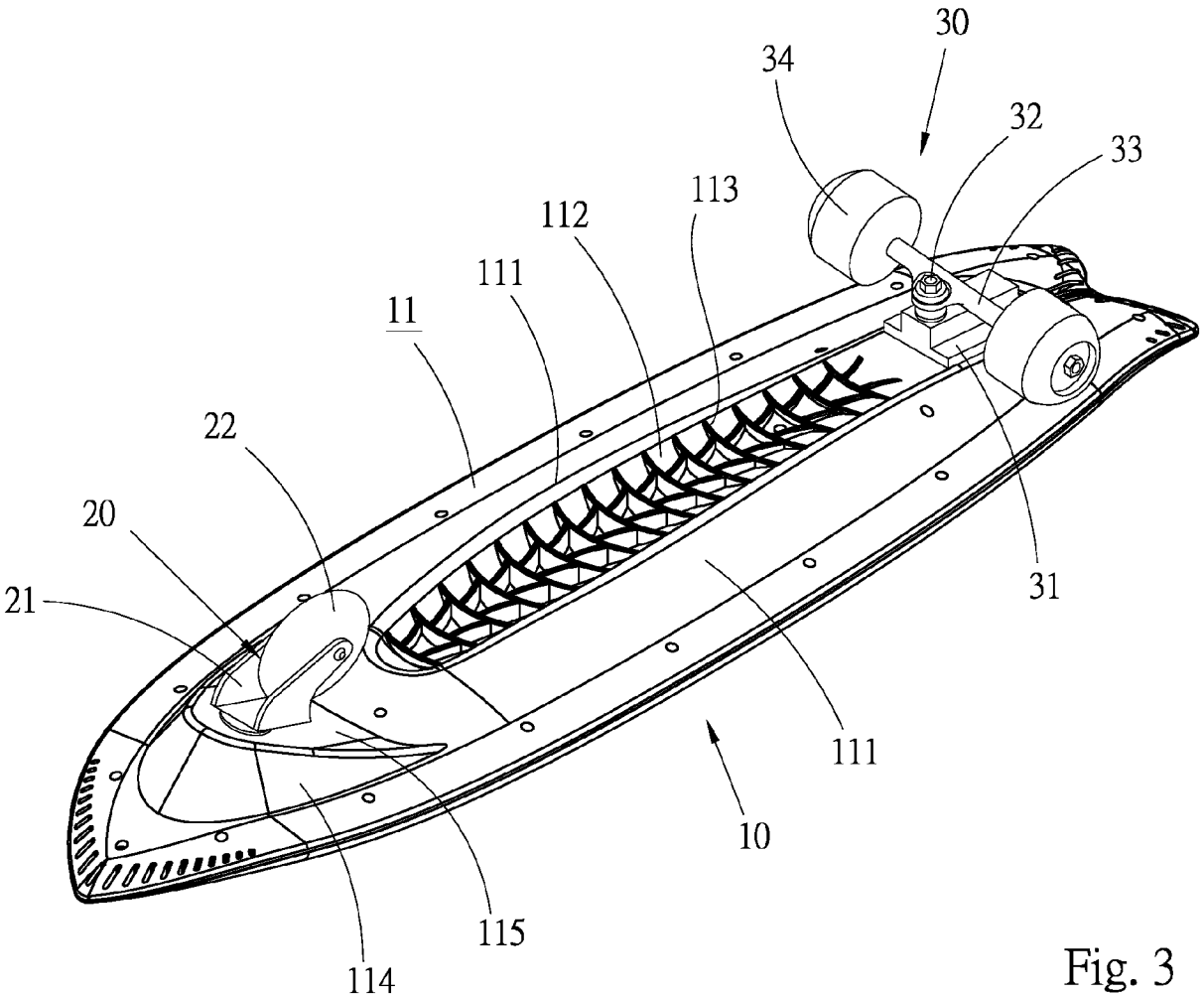
FIG. 3 is a bottom perspective view of the preferred embodiment of the present invention according to FIG. 1.

Please refer to FIGS. 1 to 3. According to a preferred embodiment, the swing skateboard of the present invention includes a board body 10, a front roller unit 20 and a rear roller unit 30.

The board body 10 is an elongated body having a front end and a rear end. The board body 10 includes a bottom board 11 and a top board 12 disposed on a top face of the bottom board 11. In this embodiment, the board body 10 is made of plastic material. Preferably, the material of the bottom board 11 and the top board 12 is Acrylonitrile-Butadiene-Stryene (ABS). Alternatively, the board body 10 can be made by means of integral injection molding.

Figure 5:
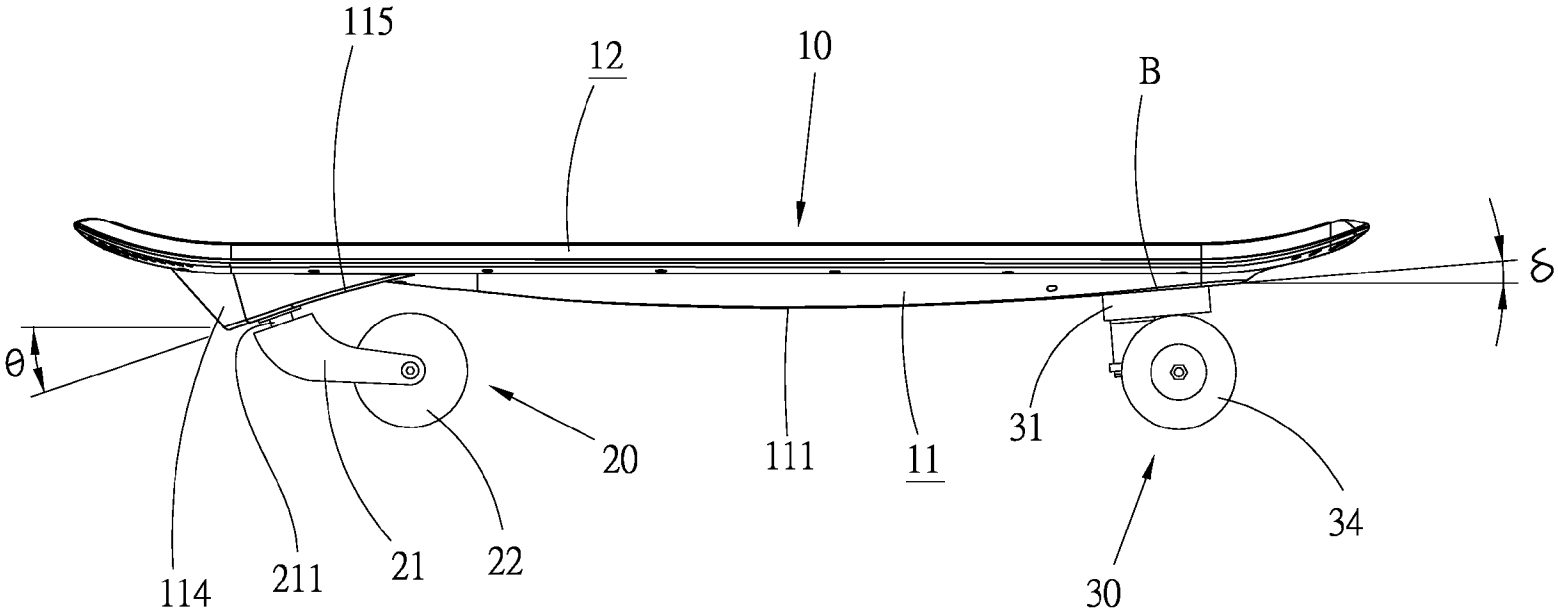
FIG. 5 is a side view of the skateboard of the present invention.
Figure 6:
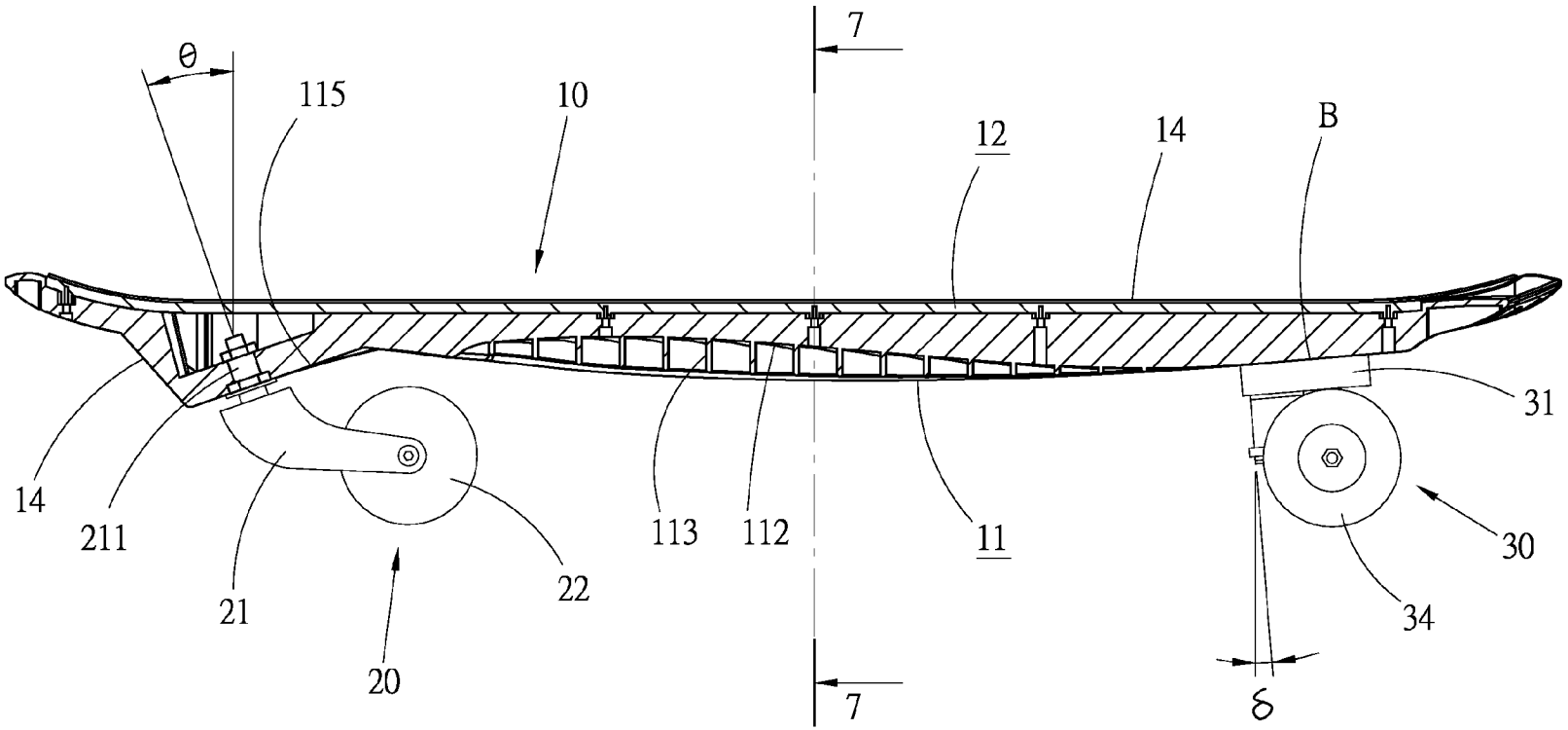
FIG. 6 is a longitudinal sectional view of the skateboard of the present invention.
Figure 7:
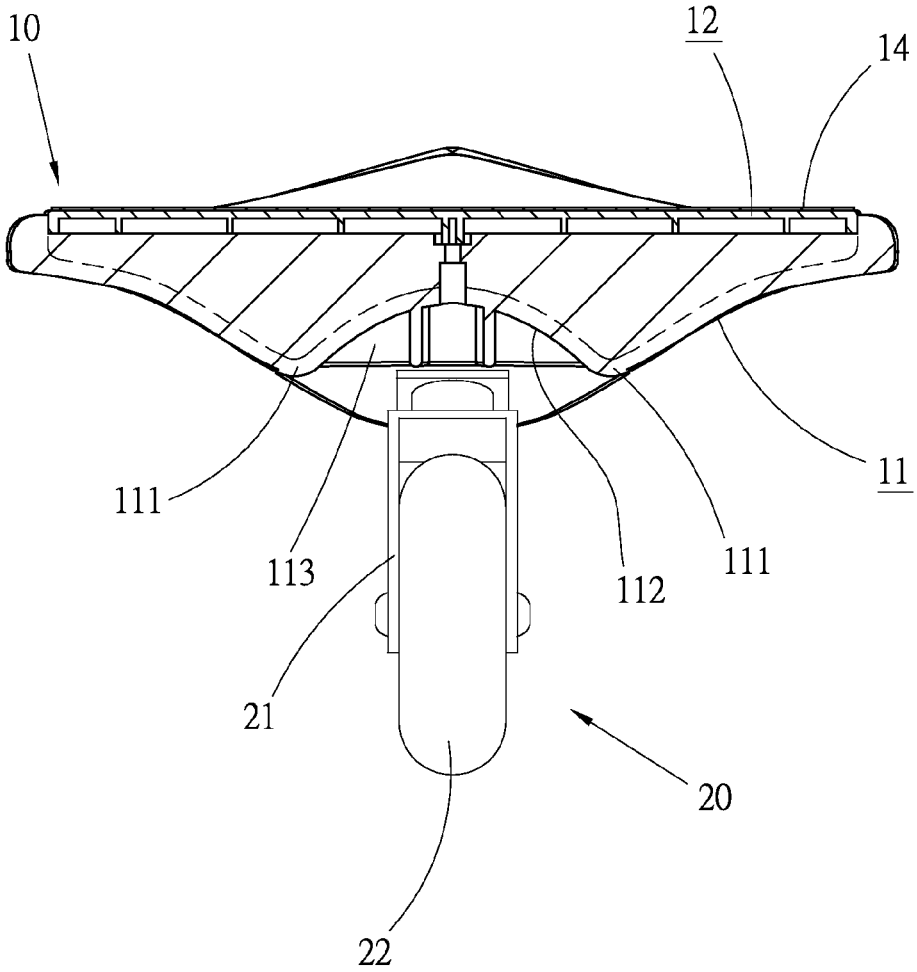
FIG. 7 is a sectional view taken along line 7-7 of FIG. 6.
Figure 10:
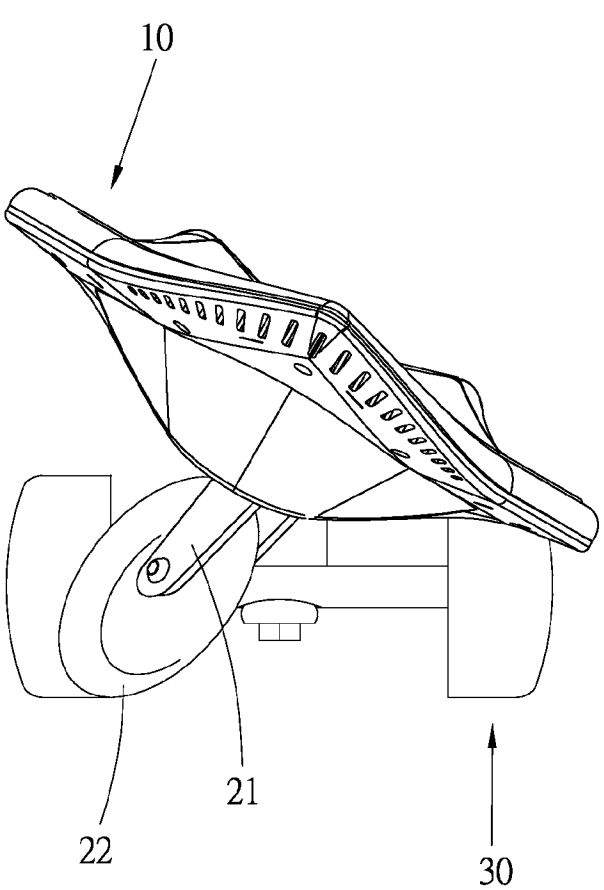
FIG. 10 is a front view of the skateboard of the present invention, showing that the board body is tilted to the other side.
Figure 8:
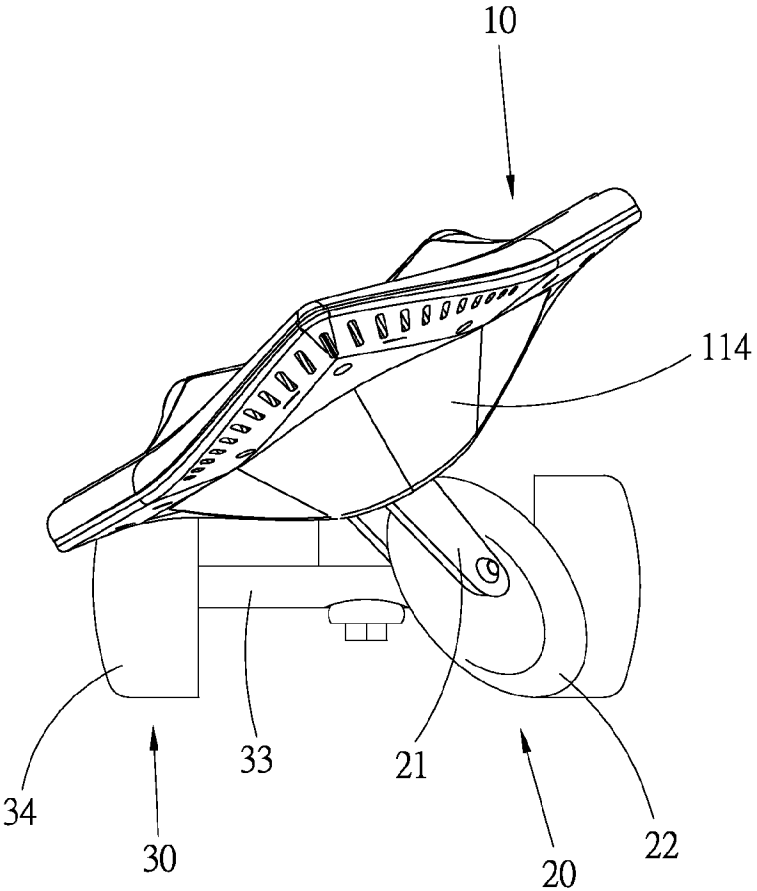
FIG. 8 is a front view of the skateboard of the present invention, showing that the board body is tilted to one side.
Figure 9:
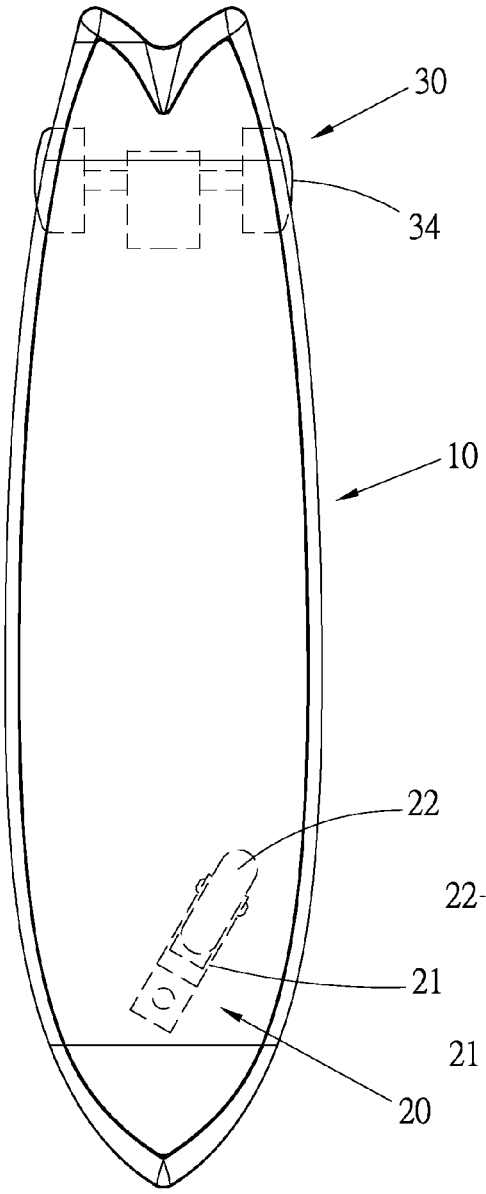
FIG. 9 is a top view of the skateboard of the present invention according to FIG. 8, showing that the front roller unit swings to one side.
Figure 11:
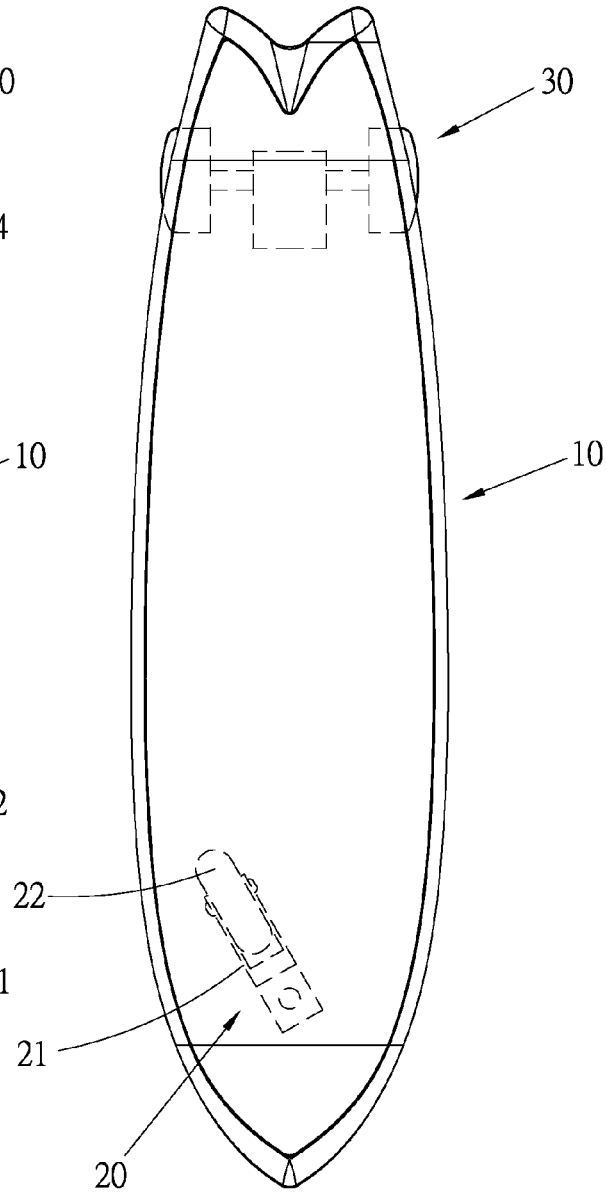
FIG. 11 is a top view of the skateboard of the present invention according to FIG. 10, showing that the front roller unit swings to the other side.

Two elongated ribs 111 are disposed under a bottom face of the bottom board 11 as shown in FIGS. 3 and 7. The two ribs 111 are positioned on two sides of the bottom board respectively and longitudinally extend along the bottom board. An elongated recess 112 is formed between the two ribs 111 and positioned at a center of the bottom board. Multiple support diaphragms 113 are disposed in the recess 112. Due to the ribs 111 and the recess 112, the bottom board 11 has a cross section with a raised/recessed configuration for increasing structural strength and load capacity of the bottom board 11. In addition, a protrudent seat 114 is disposed at the front end of the bottom face of the bottom board 11. The protrudent seat 114 has a rearward upward inclined slope 115 as shown in FIG. 5. As shown in FIG. 6, the protrudent seat 114 can be integrally formed with the board body 10. The inclination angle θ of the slope 115 ranges from 10 degrees to 30 degrees, and preferably from 15 degrees to 25 degrees. The ribs 111 are positioned behind the protrudent seat 114. The bottom board 11 has a hollow interior for reducing the weight. Multiple diaphragms 116 are disposed in the interior of the bottom board. The protrudent seat 114 is such shaped as to increase the structural strength of the bottom board 11 and enhance the impact strength of the board body 10. The ribs 111 and the recess 112 are positioned between the front roller unit 20 and the rear roller unit 30.

Figure 4:
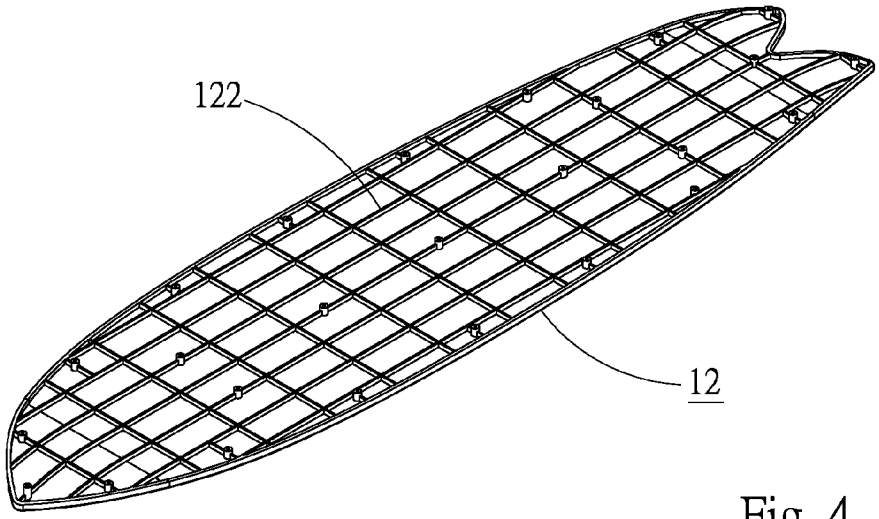
FIG. 4 is a bottom perspective view of the top board of the present invention.

The top board 12 has a bottom face under which multiple diaphragms 122 are disposed as shown in FIG. 4. The diaphragms 113, 116 and 122 all serve to increase the structural strength of the bottom board 11 and the top board 12. The top board 12 is fixedly disposed on the top face of the bottom board 11 by means of screws or any other suitable measure.

An anti-slip member 14 in the form of a thin sheet has a configuration identical to that of the top face of the board body 10. A rough anti-slip face is disposed on atop face of the anti-slip member 14. The anti-slip member 14 is fixedly disposed on the top face of the top board 12 by means of such as adhesion to provide anti-slip effect.

The front roller unit 20 has a front roller fork 21 and a front roller 22 pivotally disposed on the front roller fork 21. A rotary shaft 211 of the front roller fork 21 is pivotally disposed on the slope 115 of the protrudent seat 114 of the bottom board 11 as shown in FIG. 5. Accordingly, the front roller fork 21 can 360-degree swivel around the rotary shaft 211 under the bottom board for a user to conveniently control the moving direction of the skateboard. Due to the slope 115 of the protrudent seat 114, the rotary shaft 211 of the front roller fork 21 is not upright, but rearward inclined by the inclination angle θ.

The rear roller unit 30 has a roller seat 31 fixedly disposed at the rear end of the bottom face of the bottom board 11; a central shaft 32 having a top end connected with the roller seat 31; a rear roller shaft 33 mounted at a bottom end of the central shaft 32, and two rear rollers 34 respectively pivotally disposed at two ends of the rear roller shaft 33. The rear roller unit 30 is arranged under an inclined section B of the bottom board 11 as shown in FIG. 5. The inclined section B is rearward upward inclined by an inclination angle δ, which ranges, for example, from 5 degrees to 15 degrees. Accordingly, the central shaft 32 is also rearward inclined by the inclination angle δ.

Referring to FIGS. 8 to 11, in use, a user stands on the board body 10 of the skateboard and wiggles his/her body to change the position of the gravity center. Under such circumstance, the board body 10 is leftward or rightward tilted to make the front roller fork 21 of the front roller unit swing leftward or rightward. Accordingly, the user can move the skateboard forward without treading the ground with his/her foot to move it forward. As aforesaid, the rotary shaft 211 of the front roller fork 21 is inclined by an inclination angle, whereby the front roller fork can sensitively swivel. Also, the central shaft 32 of the rear roller unit 30 is inclined by an inclination angle. This makes it easier to bias the rear roller unit relative to the board body 10.

According to the above arrangement, the present invention has the following advantages:

1. The front roller unit 20 and the rear roller unit 30 of the present invention provide a non-collinear three-point support effect for the skateboard. Therefore, the skateboard has very good stability and is easy to use and operate.
2. A user can wiggle his/her body to tilt the board body 10 and make the skateboard move forward without treading the ground with his/her foot. The front roller fork 21 can 360-degree swivel around the rotary shaft 211 relative to the board body. Therefore, the skateboard has very good operational sensitively for the user to conveniently control the moving direction of the skateboard.
3. The board body 10 of the present invention is made of plastic material by injection molding. It is easy and quick to manufacture and process the board body 10. Therefore, the manufacturing cost is lowered. Moreover, the board body 10 can be formed with various configurations without causing the environmental protection problem due to tree logging.
4. The board body 10 of the present invention is designed with multiple reinforcement structures. For example, the board body 10 has the protrudent seat 114, the ribs 111, the recess 112 and the diaphragms 113, 116, 122 disposed on the top board and the bottom board. All these structures can increase the structural strength and strain strength of the board body 10 for the board body 10 to bear the weight of human body and treading force.

In conclusion, the swing skateboard of the present invention has very good operational sensitivity and stability and can be formed with various configurations.

The above embodiments are only used to illustrate the present invention, not intended to limit the scope thereof. Many modifications of the above embodiments can be made without departing from the spirit of the present invention.

What is claimed is:

1. A swing skateboard comprising:

a board body, which is an elongated body having a top face and a bottom face;

a front roller unit having a front roller fork rotatably located at a front end of the bottom face of the board body, and a front roller rotatably mounted on the front roller fork; and a rear roller unit having a rear roller shaft mounted at a rear end of the bottom face of the board body, and two rear rollers respectively rotatably located at two ends of the rear roller shaft, whereby when the board body is tilted to one side, the front roller unit swings to one side;

wherein the front roller fork has a rotary shaft and is pivotally located on the board body via the rotary shaft, the rotary shaft being rearward inclined by an inclination angle;

wherein the board body has a protrudent seat integrally formed therein and protruding downwardly from the front end of the bottom face of the board body, the rotary shaft of the front roller fork being pivotally connected to the protrudent seat;

wherein the protrudent seat has a rearward upward inclined slope; the rotary shaft of the front roller fork being pivotally located on the slope;

wherein an elongated recess and two elongated ribs are longitudinally formed on the bottom face of the board body, the recess being positioned at a center of the board body and the two ribs being positioned on two sides of the recess;

wherein multiple support diaphragms are located in the recess.

2. The swing skateboard as claimed in claim 1, wherein the board body includes a bottom board and a top board located on a top face of the bottom board, the bottom board having a bottom face as the bottom face of the board body; the top board having a top face as the top face of the board body.

3. The swing skateboard as claimed in claim 2, wherein multiple diaphragms are located in a position selected from a group consisting of on the bottom face of the top board and in an interior of the bottom board.

4. The swing skateboard as claimed in claim 1, further comprising an anti-slip member located on the top face of the board body.

5. The swing skateboard as claimed in claim 1, wherein the inclination angle of the rotary shaft of the front roller fork ranges from 10 degrees to 30 degrees.

6. The swing skateboard as claimed in claim 1, wherein an inclined section is located at a rear end of the bottom face of the bottom board, the inclined section being rearward upward inclined by a small inclination angle;

the rear roller unit being arranged under an inclined section.

7. The swing skateboard as claimed in claim 1, wherein the board body is made of plastic material.

8. A swing skateboard comprising:

a board body, which is an elongated body having a top face and a bottom face;

a front roller unit having a front roller, the front roller unit rotatably located at a front end of the bottom face of the board body;

a rear roller unit having a rear roller shaft mounted at a rear end of the bottom face of the board body, and two rear rollers respectively rotatably located at two ends of the rear roller shaft, whereby when the board body is tilted to one side, the front roller unit swings to one side; and two ribs are longitudinally formed on the bottom face of the board body; an recess is formed between the ribs; the ribs and the recess being positioned on the bottom face of the board body between the front roller unit and the rear roller unit;

wherein multiple support diaphragms are located in the recess;

wherein a portrudent seat is integrally formed on the front end of the bottom face of the board body and the front roller unit is pivotally connected to the protrudent seat.

* * * * *